US007995941B2

(12) United States Patent
Ozawa

(10) Patent No.: US 7,995,941 B2
(45) Date of Patent: Aug. 9, 2011

(54) IMAGE FORMING APPARATUS PERFORMING A CORRECTING OPERATION IN ACCORDANCE WITH AN OPERATION STATE OF AN IMAGE FORMING SECTION

(75) Inventor: Fusako Ozawa, Hachioji (JP)

(73) Assignee: Konica Minolta Business Technologies Inc., Tokyo (JP)

( * ) Notice: Subject to any disclaimer, the term of this patent is extended or adjusted under 35 U.S.C. 154(b) by 39 days.

(21) Appl. No.: 12/551,840

(22) Filed: Sep. 1, 2009

(65) Prior Publication Data

US 2010/0067928 A1 Mar. 18, 2010

(30) Foreign Application Priority Data

Sep. 16, 2008 (JP) ..... 2008-236774

(51) Int. Cl.
*G33G 15/00* (2006.01)
*G03G 15/01* (2006.01)
*G03G 15/16* (2006.01)

(52) U.S. Cl. ..... 399/49; 399/72; 399/75; 399/301

(58) Field of Classification Search ..... 399/49, 399/72, 39, 75, 76, 77, 301, 302; 347/19
See application file for complete search history.

(56) References Cited

U.S. PATENT DOCUMENTS

| | | | | |
|---|---|---|---|---|
| 6,385,412 | B1 * | 5/2002 | Sadakuni | 399/75 |
| 2003/0142988 | A1 * | 7/2003 | Kimura | 399/49 |
| 2008/0019739 | A1 * | 1/2008 | Oouchi | 399/301 |
| 2008/0226313 | A1 * | 9/2008 | Tsuchida et al. | 399/301 X |

FOREIGN PATENT DOCUMENTS

JP 2000-35703 A 2/2000

* cited by examiner

*Primary Examiner* — Sophia S Chen
(74) *Attorney, Agent, or Firm* — Holtz, Holtz, Goodman & Chick PC

(57) ABSTRACT

A full-color image forming apparatus for forming a toner image for each color on each image carrier, and for transferring the toner image onto a sheet, including: an image forming section for forming a correcting toner image for each color on a portion of an image carrier, wherein the portion corresponds to an interval between the successive sheets; and a control section for conducting a correcting operation of the toner image for each color, based on the correcting toner image which is formed by the image forming section, wherein, when the image forming section is possible to conduct an operation, if the image forming section is controlled to interrupt the correcting operation to use the correcting toner image yet to be formed, the control section controls the image forming section to form the residual correcting toner image, before the control section controls the image forming section to stop the operation.

5 Claims, 4 Drawing Sheets

IMAGE FORMING APPARATUS PERFORMING A CORRECTING OPERATION IN ACCORDANCE WITH AN OPERATION STATE OF AN IMAGE FORMING SECTION

CROSS REFERENCE TO RELATED APPLICATION

This application is based on Japanese Patent Application No. 2008-236,774 filed on Sep. 16, 2008, with the Japanese Patent Office, the entire content of which is hereby incorporated by reference.

TECHNICAL FIELD

The present invention relates to image forming apparatuses, such as copy machines, facsimile devices, and printers, which conduct correcting operations, such as a color-registration correction and a toner-density correction, during the image forming operation.

BACKGROUND OF THE INVENTION

In recent years, full color digital copying machines, serving as the full-color image forming apparatuses, have become widely prevalent which form full color images, based on image data of red (R), green (G) and blue (B) colors, obtained from color original documents. In order to obtain stable outputted images to satisfy the users, stabilizing controls, color-registration corrections and toner-density corrections are executed by said full-color image forming apparatuses, while said full-color image forming apparatuses do not conduct the image forming operation itself, or while said full-color image forming apparatus conducts the image forming operation as a usual copying operation. For example, concerning toner-density correction, which is conducted during image forming operation, a correction patch of each color is formed on a portion between successive transfer sheets, so that the toner-density correction can be successfully conducted, while the full productivity of said full-color image forming apparatuses is unchangeably maintained.

Unexamined Japanese Patent Application Publication No. 2000-35703 (page 6, FIG. 5) discloses an image forming apparatus in which a registration pattern for the registration correction is formed between two toner images formed on a recording member, being a first timing, and further the shifted amount of the registration of said formed registration pattern is detected at a second timing, which is different from the first timing, so that the targeted registration correction is conducted. According to said image forming apparatus, the formation and detection of the registration pattern and the registration correction are conducted at specific timings, corresponding to different sheet intervals on the image carrier, so that the interrupting time during image formation can be reduced.

SUMMARY OF THE INVENTION

However, the image forming apparatus of said Patent Application includes the problematic points listed below.

(1) While the correction patches are formed on the plural sheet intervals, corresponding to the portions between the successive transfer sheets on the image carrier, if the image forming operation is interrupted for some reason, residual correction patches, remaining during a preceding image forming operation, is continued to be formed on a next image forming operation. Whereby adverse changes occur on the image forming conditions, being environmental conditions, including temperature and humidity, as well as the image forming conditions including a DC bias voltage and a grid voltage. Due to these adverse changes, if the correction patches, having been formed under different conditions, are used for the registration correction, suitable corrections cannot be obtained as a result.

(2) Otherwise, if the correction patches are formed again on the next image forming operation, and if jobs, exhibiting the completion of a single sheet, are continued, since the correction patches are to be formed for colors of yellow (Y), magenta (M) and cyan (C), the correction patches for all colors can never be formed, whereby the desired correction results, using the correction patches will not be obtained, which is a major problem.

An aspect of the present invention is to overcome the above problems, and to provide an image forming apparatus, being able to obtain suitable correcting results with or without interruption of the correcting operation, which counter measure will now be listed below.

Item 1. A full-color image forming apparatus for forming a toner image for each color on each image carrier, and for transferring the toner image onto a recording sheet, including:

an image forming section for forming a correcting toner image for each color on a portion of an image carrier, wherein the portion corresponds to an interval between the successive recording sheets; and a control section for conducting a correcting operation of the toner image for each color, based on the correcting toner image formed by the image forming section, wherein, when the image forming section is possible to conduct an operation, if the image forming section is controlled to interrupt the correcting operation to use the correcting toner image, the control section controls the image forming section to form the residual correcting toner image yet to be formed, before the control section controls the image forming section to stop the operation.

In the full-color image forming apparatus, relating to the present invention, before the image forming section is controlled to stop the operation, the correcting toner image for each color can be formed. Accordingly, the correcting toner image for each color can be formed under the same environment and same image forming conditions. Additionally, the portion between the successive recording sheets includes a portion between the last recording sheet of a present job and the first recording sheet of a next job.

Item 2. A full-color image forming apparatus for forming a toner image for each color of an original document on each image carrier, and for transferring the toner image onto a recording sheet, including:

an image forming section for forming a correcting toner image for each color on a portion of an image carrier, wherein the portion corresponds to an interval between the successive recording sheets; and a control section for conducting a correcting operation of the toner image for each color, based on the correcting toner image formed by the image forming section, wherein, if the image forming section is controlled to interrupt the correcting operation to use the correcting toner image, the control section controls the image forming section to together form the correcting toner image for each color, before the image forming section forms the toner image as a next job.

In the full-color image forming apparatus, relating to the present invention, if the correcting operation to use the correcting toner image is interrupted, when the next job is started, the correcting toner image for each color can be formed together. Accordingly, the correcting toner image for each color can be formed under the equal environment and equal image forming condition. Additionally, the job in the present invention includes successive operations, relating to image formation in the full-color image forming apparatus. For example, when a plurality of recording sheets are to be outputted, successive operations, to output the plurality of the recording sheets, represent a single job. Further, when a plurality of copy units are to be outputted, successive operations to output the plurality of copy units represent a single job.

Item 3. A full-color image forming apparatus for forming a toner image for each color on each image carrier, and for transferring the toner image of the original document onto a recording sheet, including:

an image forming section for forming a correcting toner image for each color on a portion of an image carrier, wherein the portion corresponds to an interval between the successive recording sheets; and a control section for conducting a correcting operation of the toner image for each color, based on the correcting toner image, formed by the image forming section, wherein, when the image forming section is possible to conduct the operation, if the image forming section is controlled to interrupt the correcting operation to use the correcting toner image, the control section controls the image forming section to form residual correcting toner images yet to be formed, by a first recovery-correcting operation, wherein, if the image forming section is controlled to interrupt correcting operation to use the correcting toner image, the control section controls the image forming section to together form the correcting toner image for each color by a second recovery-correcting operation, before the image forming section forms the toner images in a next job, and the control section determines whether to operate the first recovery-correcting operation or the second recovery-correcting operation, based on stopping conditions of the image forming sections.

In the full-color image forming apparatus relating to the present invention, when the correcting operation to use the correcting toner image is interrupted, either the first recovery-correcting operation or the second recovery-correcting operation is selected to be used, based on the stopping conditions of the image forming section. In the first recovery-correcting operation or the second recovery-correcting operation, the correcting toner image of each color is formed together in the same image forming operation. Accordingly, the correcting toner image for each color can be formed under the same environment and same image forming condition.

BRIEF DESCRIPTION OF THE DRAWINGS

The embodiments will now be described, by way of example only, with reference to the accompanying drawings which are meant to be exemplary, not limiting, and wherein like elements are numbered alike in the several figures, in which.

DETAILED DESCRIPTION OF THE PREFERRED EMBODIMENT

Figure 1:
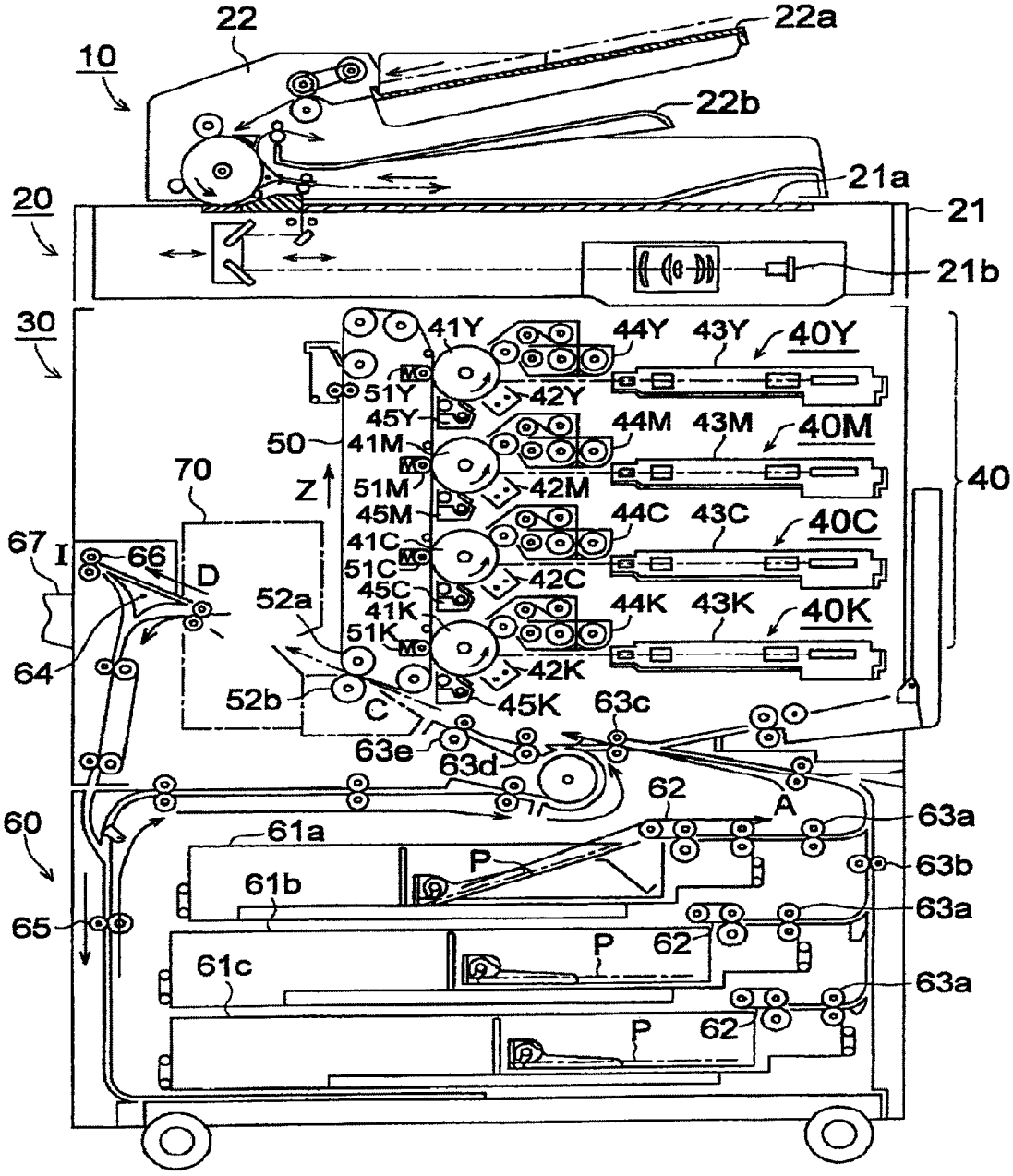
FIG. 1 shows an overall structure of a full-color image forming apparatus relating to an embodiment of the present invention.

An embodiment of the present invention will now be detailed while referring to the drawings.

[Structure of the Full-color Image Forming Apparatus]

FIG. 1 shows a structure of full-color image forming apparatus 10 relating to an embodiment of the present invention. Full-color image forming apparatus 10, relating to the present invention, controls image forming section 40 in such ways that when the correcting operation to use correcting patch 80 (see FIG. 3) is interrupted, a residual correcting patch (which is a correcting toner image) yet to be formed is formed before image forming section 40 is deactivated, or when a next job is started, correcting patches 80 are formed together. Accordingly, the plurality of correcting images are formed under the same environment and same image forming condition.

Full-color image forming apparatus 10 includes image reading section 20 and main image forming apparatus body 30. Image reading section 20, mounted on a top section of main image forming apparatus body 30, is structured of image scanner 21, scanner cover 22, and the like. Image scanner 21 emits the light rays to a surface of an original document placed on platen 21*a*. CCD (being a charged coupled device) 21*b* receives the light rays reflected from the surface of the original document, and photo-electrically transforms the reflected light rays to digital image data.

Scanner cover 22, mounted on image scanner 21, is openable and closable. The original documents, stacked on tray 22*a*, are conveyed one by one onto platen 21*a* of image scanner 21. After images, carried on a single surface or both surfaces of the original document, have been read, the original document is conveyed to ejection tray 22*b*.

Main image forming apparatus body 30, which is called a tandem-type color image forming apparatus, includes image forming section 40, intermediate transfer belt 50 (which is an image carrier, rotating in arrow direction Z), sheet supplying section 60, and image fixing section 70. Image forming section 40 is structured of yellow image forming section 40Y, magenta image forming section 40M, cyan image forming section 40C, and black image forming section 40K. Based on instructions coming from general control section 100, above described color image forming sections 40Y, 40M, 40C and 40K form correcting patches 80 on portions of transfer belt 50, corresponding to the portions between successive sheets P, in which, successive sheets P are in close contact with intermediate transfer belt 50 by secondary transfer rollers 52*a* and 52*b*.

Yellow image forming section 40Y, being a unit to form images of yellow color (Y), includes not only photoconductive drum 41Y, on a surface of which electrostatic latent images are formed, but also includes various sections arranged around photoconductive drum 41Y, wherein said various sections represent electrical charging section 42Y, exposure section 43Y, developing section 44Y, and cleaning section 45Y.

Similarly, magenta image forming section 40M, being a unit to form images of magenta color (M), includes not only photoconductive drum 41M, on a surface of which electrostatic latent images are formed, but also includes various sections, arranged around photoconductive drum 41M, wherein said various sections represent electrical charging section 42M, exposure section 43M, developing section 44M, and cleaning section 45M.

Identically, cyan image forming section 40C, being a unit to form images of cyan color (C), includes not only photoconductive drum 41C, on a surface of which electrostatic latent images are formed, but also includes various sections, arranged around photoconductive drum 41C, wherein said various sections represent electrical charging section 42C, exposure section 43C, developing section 44C, and cleaning section 45C.

Lastly, black image forming section 40K, being a unit to form images of black color (K), includes not only photoconductive drum 41K, on a surface of which electrostatic latent images are formed, but also includes various sections, arranged around photoconductive drum 41K, wherein said various sections represent electrical charging section 42K, exposure section 43K, developing section 44K, and cleaning section 45K.

Intermediate transfer belt 50, being an endless belt, and entrained about a plurality of rollers, is configured to rotate due to the rotation of the plurality of rollers (See FIG. 1, arrow Z). Toner images of yellow (Y), magenta (M), cyan (C), and black (K) are developed respectively on the surfaces of photoconductive drums 41Y, 41M, 41C and 41K. The developed toner images are transferred respectively onto intermediate transfer belt 50, as the primary transfer operations, at contacting positions of intermediate transfer belt 50 with primary transfer rollers 51Y, 51M, 51C and 51K. When transfer belt is rotated by the rotations of the plurality of rollers in direction Z, each toner image, being the yellow image, the magenta image, the cyan image, and the black image, is transferred to be superposed onto intermediate transfer belt 50, whereby the superposed toner images are conveyed toward secondary transfer rollers 52*a* and 52*b*. The superposed toner images are transferred together onto a surface of recording sheet P by secondary transfer rollers 52*a* and 52*b*, which is a secondary transfer operation.

Sheet supplying section 60 is structured of sheet trays 61*a*, 61*b*, and 61*c*, feed-out roller 62, sheet supplying roller 63*a*, conveyance rollers 63*b*, 63*c* and 63*d*, registration roller 63*e*, separating point 64, sheet reversing roller 65, sheet ejection roller 66, sheet ejection tray 67, and the like members. Sheet supplying section 60 is configured to convey sheet P, accommodated in recording sheet supplying trays 61*a*, 61*b*, and 61*c*, toward sheet ejection tray 67, through predetermined routes, which are represented by point A to point I.

Image fixing device 70 heats sheet P, onto which the image has been secondarily transferred from intermediate transfer belt 50 by secondary transfer rollers 52*a* and 52*b*. The images, having been transferred to sheet P is permanently fixed onto sheet P by heat coming from image fixing device 70.

Figure 2:
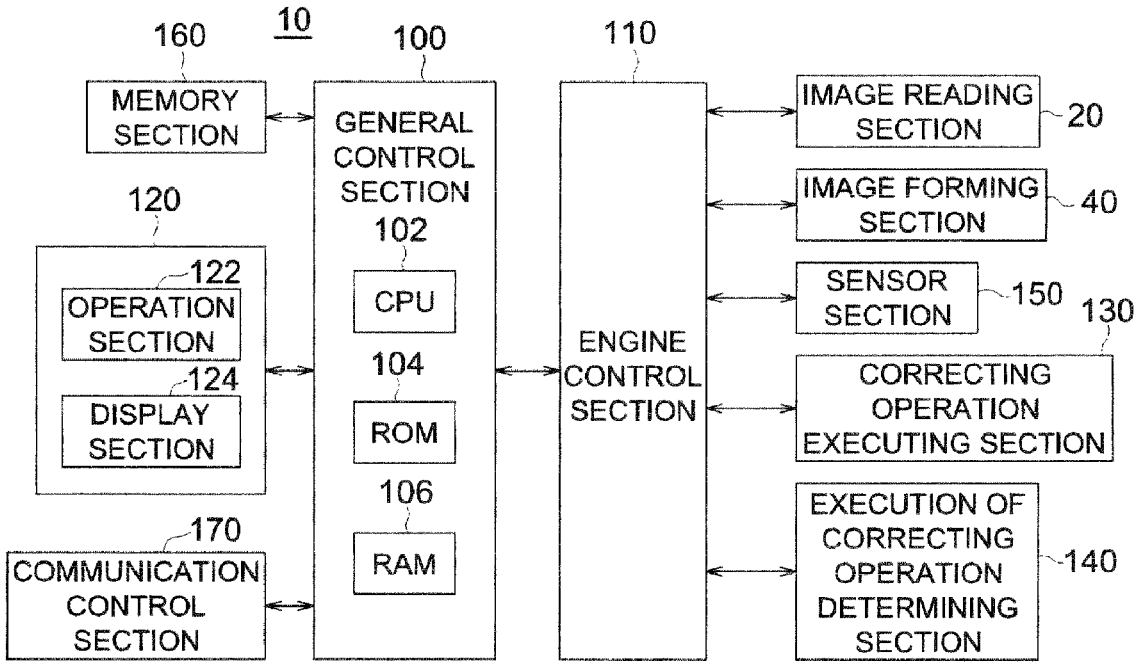
FIG. 2 is a block diagram of the full-color image forming apparatus.

FIG. 2 is a block diagram of full-color image forming apparatus 10, which includes general control section 100 serving as an example of the control section, engine control section 110, image reading section 20, image forming section 40, sensor section 150, operation display section 120, communication control section 170, memory section 160, correcting operation executing section 130, and execution determining section 140 serving as an example of the control section.

Based on the instruction, being control signals sent from general control section 100, engine control section 110 controls to operate image reading section 20, image forming section 40, sensor section 150, correcting-operation executing section 130, and execution determining section 140. Image reading section 20 converts image information, being analog information, read by image scanner 21 (see FIG. 1), into digital image signals, and outputs the digital image signals to general control section 100 and the like sections.

Image forming section 40 includes intermediate transfer belt 50, sheet supplying section 60, and image fixing section 70 (see FIG. 1). Based on the instructions, sent from general control section 100 through engine control section 110, image forming section 40 outputs images, based on the image data stored in a data file of reserved job contents in memory section 160, and transfers the toner images onto sheet P supplied from sheet supplying section 60, to form an identical image.

Sensor section 150 is structured of an electrical potential sensor, an adhered-toner volume sensor, a position sensor, a toner-density detection sensor, and the like sensors. The electrical potential sensor and the adhered-toner volume sensor are used for the stabilizing control, the position sensor is used for color-registration correction, and the toner-density detection sensor is used for toner-density correction. To conduct the toner-density correction, after the toner-density detection sensor has detected the toner density of correcting patch 80, formed on intermediate transfer belt 50, said toner-density detection sensor generates a signal concerning the detected toner density (being the detected density of the patch), and outputs said signal to general control section 100 through engine control section 110.

Operation display section 120 includes operation section 122 and display section 124. In the present embodiment, a touch panel is employed, in which operation section 122 and display section 124 are united. An electrical capacitance method, a resistive method, or a surface elastic wave method (being an SAW method) is employed in an input detection device, serving as operation section 122. Operation section 122 detects input information (being an input position) which is inputted by the user on an operation panel displayed on display section 124. Based on said detected information, operation section 122 generates a detection signal, and supplies the detection signal to general control section 100.

Display section 124 is structured of a liquid crystal display, or an organic light emitting display. Based on the image signal in accordance with the detection signal, detected by operation section 122 and supplied from general section 100, display section 124 conducts a predetermined display process. In the present embodiment, to display the frequency to be conducted by the correcting operation, a correcting frequency setting screen (being the operation panel) is displayed on display section 124. On said correcting frequency setting screen, among four steps of the correcting frequencies (being 30 prints, 50 prints, 100 prints or 250 prints, for example), the user can select a frequency, based on the image quality desired by the user. If "30 prints", as the desired frequency, is selected by the user via the operation on operation section 122, a single correction operation is performed after every 30 prints. Further, on the screen of display section 124, a "processing line speed setting screen" is displayed, through which, a correcting speed is selected for a correcting operation concerning a total processing line speed, or concerning a processing line speed for a job to be conducted, which will be detailed later.

Communication control section 170, structured of a MODEM, a terminal adaptor, and a LAN adaptor, controls communication to an external device, from which communication control section 170 receives information for the contents of a reserved job, such as image data, and the number of sheets to be outputted, whereby communication control section 170 outputs said information to general control section 100.

Memory section 160 is structured of HDD (being a hard disk drive) or a semiconductor memory. Memory section 160 memorizes image data read by image reading section 20, character and image data sent from a computer, which is not illustrated, connected to image forming apparatus 10, operation screen data displayed on operation display section 120, and information for the correcting operation to start the second recovery-correcting operation, before the job is actually started, which will be detailed later.

General control section 100 is structured of CPU (being a central processing unit) 102, ROM (being a read only memory) 104, and RAM (being a random access memory) 106. ROM 104 has programs to drive image forming apparatus 10. RAM 106 is used as a temporary storage area to store the program read out from ROM 104, and input information sent from display section 124. CPU 102 reads out the programs from ROM 104 and conducts processes based on the program. For example, CPU 102 reads out a program to conduct the correcting operations, such as the toner-density correction, and the color-registration correction, whereby CPU 102 conducts the correcting operation, based on the program.

General control section 100 calculates a correction value, based on the detection signal, supplied from sensor section 150, and conducts feedback control of the calculated correction value. For example, when toner-density correction is to be conducted as a correction operation, general control section 100 calculates a correction value, based on the detection signal, detected by sensor section 150, from correction patch 80, formed on intermediate transfer belt 50. General control section 100 then feeds back the calculated value to a developing DC bias voltage or a grid voltage.

Further, general control section 100 generates timing information to show timing for conducting the correcting operation, based on the correction-frequency setting information which has been inputted from operation section 122, and also supplies said timing information to correcting operation conducting section 130. Said correcting operation includes a correcting operation of toner density, by which correction patch 80 is formed between successive recording sheets, while image forming section 40 conducts the image forming operation. Toner-density correction is conducted at a portion of the image carrier, which is between successive recording sheets P, while no image forming operation is conducted, or while the image forming operation is conducted, but the print productivity is not reduced. The correcting operation, to be conducted during the image forming operation, will now be detailed in the present example.

Toner-density correction is conducted to maintain targeted Y, M, C and K color toner densities. In the correcting operation as toner-density correction, after correction patch 80 for the correction is formed between the plural recording sheets, the values outputted from sensor section 150 is corrected at a predetermined interval for the toner-density correction, whereby the desired outputted level is maintained.

Color-registration correction is conducted to minimize positional shifts of yellow (Y), magenta (M), cyan (C), and black (K) toner images. Due to the correcting operation as the color-registration correction, after a correction patch (having an image of numeral "7", for example) is formed between plural sequential recording sheets on the intermediate transfer belt, sensor section 150 detects the formed correction patch, whereby any positional shifts of color images are corrected.

During the above correcting operation, if the correcting operation is stopped for any of various reasons, such as the completion of the outputting operation for the instructed job, jamming of recording sheets, opening and closing of a door of the image forming apparatus, interruption of outputting of the printed recorded sheets, or no more sheets stored in the sheet supplying tray, general control section 100 is configured to conduct the first recovery-correcting operation or the second recovery-correcting operation, both of which will be detailed later. At this time, to show the reason of the interruption, general control section 100 generates information of the interruption, and supplies said information to execution determining section 140.

When the correcting operation is interrupted, execution determining section 140 determines whether to execute the first recovery-correcting operation or the second recovery-correcting operation, based on said information of the interruption, supplied by general control section 100, through engine control section 110. Execution determining section 140 includes a memory section, which is not illustrated, to memorize information of the interruption, paired with the first and second recovery-correcting operation. Further, when the correcting operation is interrupted, execution determining section 140 reads out the first or second recovery-correcting operation, corresponding to information of the interruption, supplied from general control section 100, from the memory section. Still further, execution determining section 140 supplies determining information to correcting-operation executing section 130, through general control section 100, wherein said determining information is based on the first or second recovery-correcting operation, which are read out from the memory section.

The first recovery-correcting operation is conducted in such a way that even when image forming section 40 has interrupted the correcting operation of correcting patch 80, if image forming section 40 can still operate, image forming section 40 is controlled to form residual correcting patch 80 yet to be formed, among correcting patches 80 of each color, before image forming section 40 stops the operation. The second recovery-correcting operation is conducted in such a way that when image forming section 40 has interrupted the correcting operation of correcting patch 80, image forming section 40 is controlled to form correcting patch 80 of each color when the next job is started (that is, before the image is formed for the next job).

Correcting-operation executing section 130 executes stabilizing control, color-registration correction, and toner-density correction, in accordance with instruction sent from general control section 100. Further, when color-registration correction or toner-density correction is interrupted, correcting-operation executing section 130 executes the first or second recovery-correcting operation, based on determining information, which is supplied from execution-determining section 140, through general control section 100.

[Toner-Density Correction]

Figure 3:
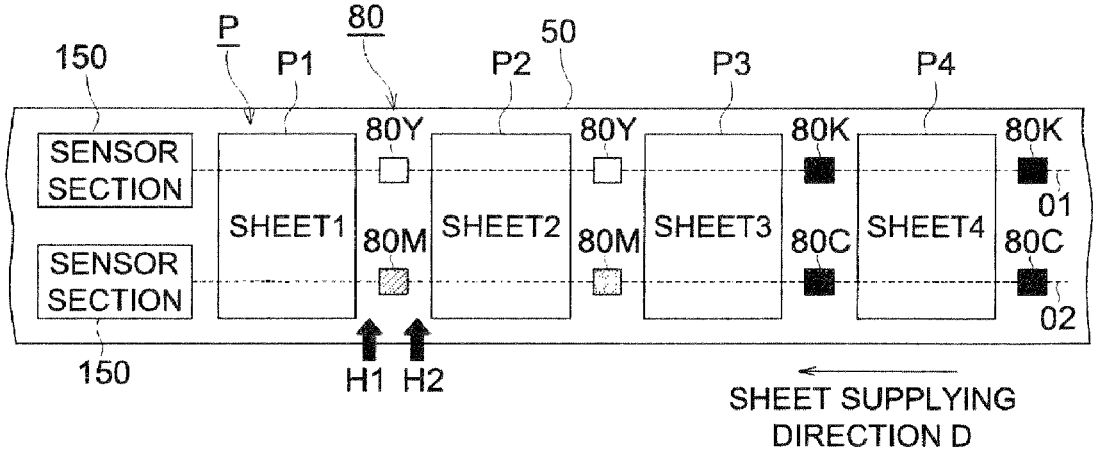
FIG. 3 shows correction patches formed on portions of an image carrier, in which said portions correspond to positions between successive recording sheets.

FIG. 3 details the toner-density correction to be conducted during the image forming operation as a normal case. In FIG. 3, for example, the images are formed on recording sheets P1, P2, P3 and P4, being totally four recording sheets for a single job, and correction patches 80 are formed between these recording sheets P.

Recording sheet P is conveyed in sheet supplying direction D, onto which a predetermined toner image is transferred from intermediate transfer belt 50. Sensor sections 150, totally two pieces, are installed at downstream portions, in sheet supplying direction D of intermediate transfer belt 50.

Sensor sections 150 are installed adjacent to the longer edge of sheet P, to detect correction patches 80.

Correction patch 80, serving as the toner-density correction, is an example of a toner image for the correction, which is formed between successive recording sheets P on intermediate transfer belt 50. Correction patch 80 is structured of two sets for each color, so that total eight patches are provided, including two of each correction patch 80Y, 80M, 80C, and 80K, whereby between successive recording sheets P, two sets of correction patches 80 for different color are created to meet sensor detection axes O1 and O2, above intermediate transfer belt 50.

In detail, between a trailing edge of preceding recording sheet P1 and a leading edge of succeeding recording sheet P2, yellow color correction patch 80Y and magenta color correction patch 80M are formed on intermediate transfer belt 50. In the same way as above, between recording sheets P2 and P3, another set of yellow color correction patch 80Y and magenta color correction patch 80M are formed. Between recording sheets P3 and P4, black color correction patch 80K and cyan color correction patch 80C are formed. After recording sheet P4, another set of black color correction patch 80K and cyan color correction patch 80C are formed.

At timing H1 for switching processing conditions of the correction patch, general control section 100 switches the processing conditions, such as the direct current bias voltage for image development, and the grid voltage, for example, and forms correction patches 80Y and 80M. Said timing H1 for switching processing conditions for the correction patch represents timing that is prior to formation of the correction patch, and after the preceding recording image has been formed. Further at timing H2 for switching the processing condition toward normal output operation, general control section 100 switches the processing condition toward the condition to form the image to be recorded, and forms the image on recording sheet P2. Said timing H2 for switching the processing condition toward the normal output operation represents timing that is before forming the succeeding recording image, and after the preceding correction patches have been formed.

Further, since image forming apparatus 10 is configured to operate at three processing line speeds, image forming apparatus 10 is able to select an optimal processing line speed for the recording sheets to be used, based on the type or weight of the recording sheets. Accordingly, the processing condition for forming the recording image differs, based on the processing line speed, whereby the above described correcting operation is necessary to be conducted for each processing line speed.

As described above, general control section 100 (in detail, being correcting-operation executing section 130) forms two sets of correction patches 80, each being the same color, but exhibiting different processing conditions, whereby an approximation formula is obtained by sampling results of said two correction patches 80, and general control section 100 obtains a final correction value of toner density.

In the present embodiment, if the correcting operation is interrupted for any reason during the operation of the toner-density correction, either the first recovery-correcting operation or the second recovery-correcting operation is executed, based on the interrupted condition of the correcting operation. The first recovery-correcting operation and the second recovery-correcting operation will be detailed below.

(1) First Recovery-Correcting Operation

Figure 4:
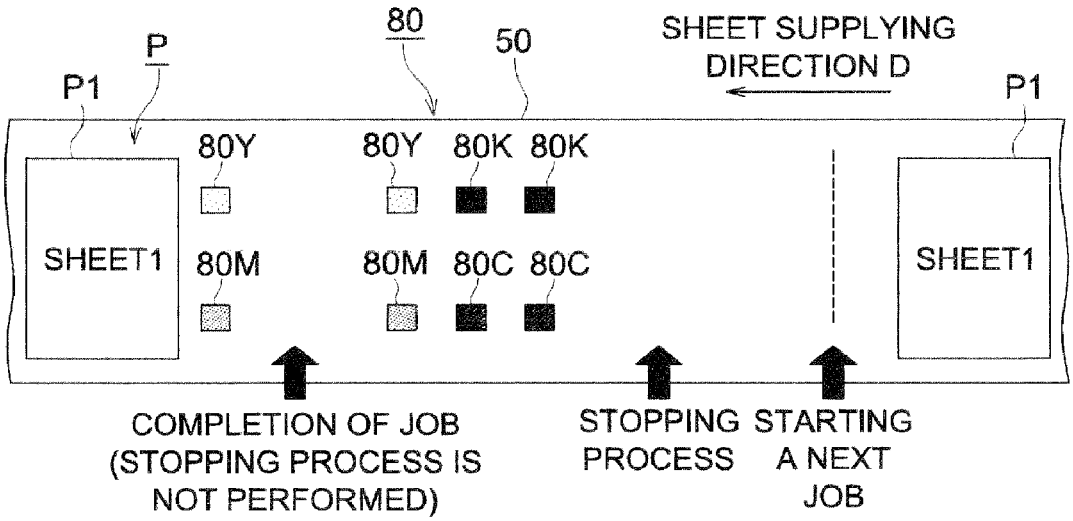
FIG. 4 details a first recovery-correcting operation which is conducted when a correcting operation is interrupted.

FIG. 4 details the first recovery-correcting operation. In said figure, after a predetermined image is formed on recording sheet P, and after correction patches 80Y and 80M are formed, if the correcting operation is interrupted, the first recovery-correcting operation is executed. That is, said first recovery-correcting operation is executed, when interrupting conditions of image forming section 40 are created by the interruption of printing operation instructed by the user, or created due to no recording sheet stored in the sheet supplying tray.

In the first recovery-correcting operation, image forming section 40 is not necessary to be stopped at once, and subsequent operations are possible to be operated. Accordingly, residual correction patches 80Y, 80M, 80C, and 80K are together formed on intermediate transfer belt 50, before image forming section 40 stops the operation. When all of correction patches 80Y, 80M, 80C, and 80K have been formed, image forming section 40 (that is, within image forming apparatus 10) stops the operation. Due to these operating steps, correction patches 80Y, 80M, 80C, and 80K can be formed, before image forming section 40 stops the operation, whereby correction patches 80Y, 80M, 80C, and 80K can be formed under the same environment and the same operating conditions.

(2) Second Recovery-Correcting Operation

Figure 5:
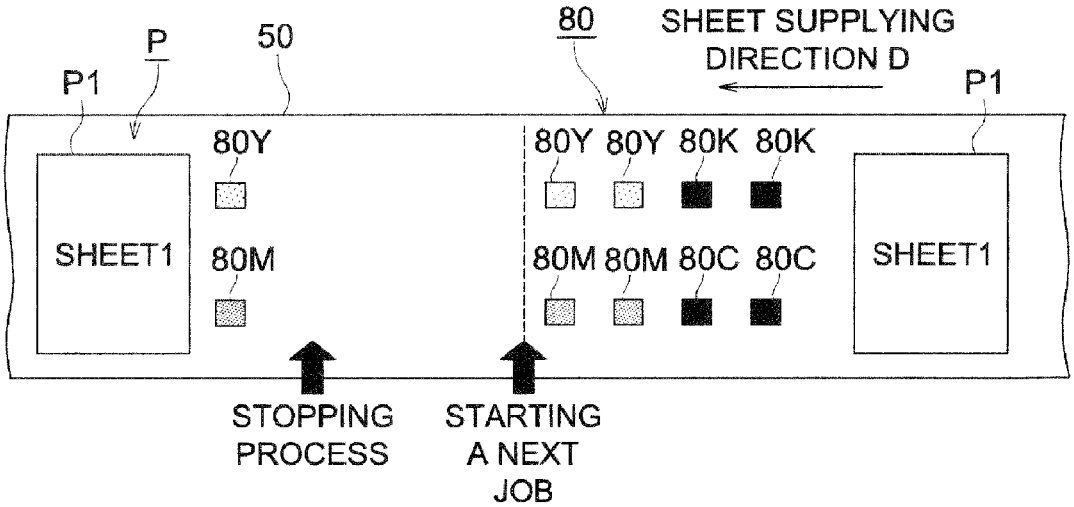
FIG. 5 details a second recovery-correcting operation which is conducted when a correcting operation is interrupted.

FIG. 5 details the second recovery-correcting operation. In said figure, after a predetermined image is formed on recording sheet P, and after correction patches 80Y and 80M are formed, the second recovery-correcting operation is executed. That is, said second recovery-correcting operation is executed, when interrupting conditions of image forming section 40 are created due to jamming of recording sheets, or opening and closing operations of a door of main image forming apparatus body 30.

In the second recovery-correcting operation, after the operation of image forming section 40 is once stopped, correction patches 80Y, 80M, 80C, and 80K are together formed on intermediate transfer belt 50, before any image for a subsequent job is formed. When all of correction patches, namely 80Y, 80M, 80C, and 80K, have been formed, the formation of images for said subsequent job is started. Due to these operations, correction patches 80Y, 80M, 80C, and 80K can be formed, when the subsequent job is started, whereby correction patches 80Y, 80M, 80C, and 80K can be formed under the same environment and the same operating conditions.

[Operation of the Image Forming Apparatus]

Figure 6:
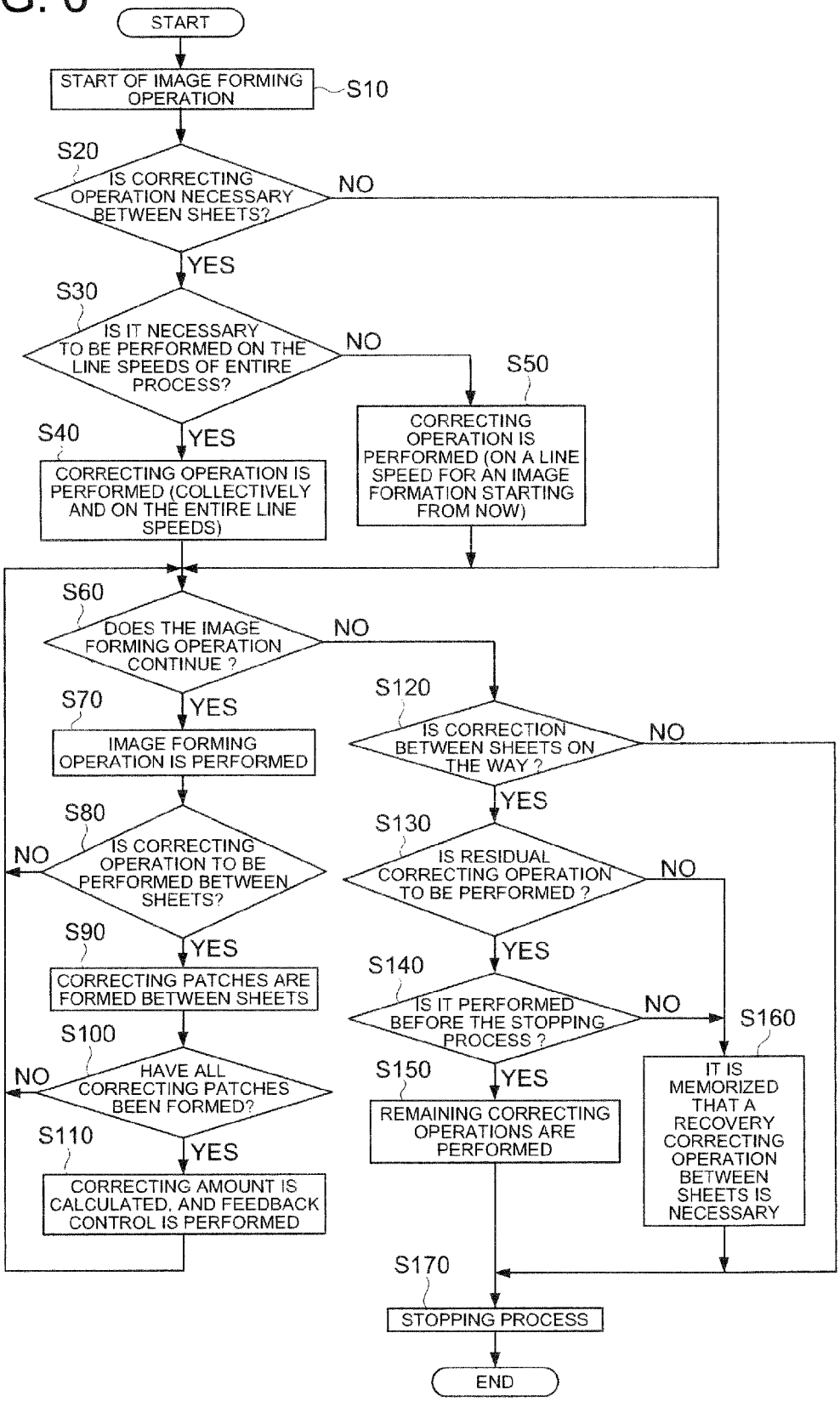
FIG. 6 is a control flow chart showing an example of operations conducted by a general control section of the full-color image forming apparatus.

FIG. 6 shows a control flow chart as an example of the control of the toner-density correction, executed by general control section 100 of image forming apparatus 10. Firstly, in step S10, general control section 100 starts the image forming operation to execute a job inputted by the user.

In step S20, general control section 100 determines whether the second recovery-correcting operation is necessary to be executed for the toner-density correction between successive recording sheets. If information for the correcting operation has been stored in memory section 160, general control section 100 determines that the recovery operation is necessary, and then general control section 100 advances the control flow to step S30. In this case, general control section 100 reads out said information for the correcting operation from memory section 160, before image forming section 40 starts the image formation. Further, if no information for the correcting operation has been stored in memory section 160, general control section 100 determines that the no recovery operation is necessary, and then the control flow advances to step S60.

In step S30, general control section 100 determines whether a correcting operation of the total processing line speed is necessary. In detail, general control section 100 determines whether to execute the correcting operation for the total processing line speed or not, based on information selected by the user on the "processing line speed setting screen" of display section 124. If general control section 100 determines that the correcting operation for the total processing line speed is necessary, the control flow advances to step S40, while if general control section 100 determines it not to be necessary, the control flow advances to step S50.

In step S40, general control section 100 executes the second recovery-correcting operation for the total processing line speed, before the image formation is started at the start of job. For example, if the processing line speed includes three types, after general control section 100 forms correction patches 80Y, 80M, 80C, and 80K for the first line speed, general control section 100 forms correction patches 80Y, 80M, 80C, and 80K for the second line speed, and finally, general control section 100 forms correction patches 80Y, 80M, 80C, and 80K for the third line speed.

In step S50, general control section 100 executes the second recovery-correcting operation for the processing line speed for the image formation to be started from now. For example, general control section 100 forms correction patches 80Y, 80M, 80C, and 80K for the first processing line speed which has been set.

In step S60, general control section 100 determines whether to continue the image forming operation. If the present job is ongoing, the control flow advances to step S70. On the other hand, if general control section 100 determines that the image forming operation has not been continued for any of the following reasons, due to the user's instruction to interrupt the print output, due to jamming of recording sheets, due to the opening and closing operation of the door of main image forming apparatus body 30, or due to the completion of outputting operation for the instructed job, the control flow then advances to step S120.

In step S70, general control section 100 executes the image forming operation to form the predetermined images on recording sheet P, after which the control flow advances to step S80.

In step S80, general control section 100 determines whether to execute a correcting operation between successive recording sheets P. General control section 100 executes the operation of toner-density correction, based on a correcting frequency inputted by the user, via the correcting frequency setting screen. For example, if "100 prints" is selected by the user, via the correcting frequency setting screen, when the number of the recording sheets carrying the formed images becomes greater than 100 sheets, correction patches 80 are formed between four sheets P after said 100 sheets (See FIG. 3). If the frequency setting has been inputted by the user via the correcting frequency setting screen, general control section 100 determines that the correcting operation is necessary to be executed, and then the control flow advances to step S90. If no frequency setting has been inputted by the user, general control section 100 determines that no correcting operation is necessary to be executed, and then the control flow goes to step S60.

In step S90, general control section 100 controls correcting-operation executing section 130 to form correction patches 80 between successive recording sheets P. Based on the instruction from general control section 100, correcting-operation executing section 130 controls image forming section 40 to form correction patches 80Y, 80M, 80C, and 80K, between successive recording sheets P, as shown in FIG. 3. Due to these controls, correction patches 80Y, 80M, 80C, and 80K are formed between successive recording sheets P.

In step S100, general control section 100 determines whether all of correction patches 80, being a total of 8 patches, have been formed or not. In detail, for example, based on the detected signals of correction patches 80K and 80C, sent from sensor section 150, general control section 100 determines whether correction patches 80 for all colors are completely formed or not. If general control section 100 determines that all correction patches 80 have been formed, the control flow advances to step S110, and if general control section 100 determines that not all correction patches 80 have been formed, the control flow returns to step S60.

In step S110, general control section 100 calculates the amount of correction for toner density, based on correction patches 80 for all colors, which have been detected by sensor section 150, and feeds back said calculated correcting amount to image forming section 40, and the control flow returns to step S60. Due to this feedback control, the toner-density correction can be executed, and the stable images are obtained by the present invention.

In step S120, general control section 100 determines whether the forming operation of correcting patches 80 is being carried out between successive recording sheets P. For example, during formation of correction patches 80, if the image forming operation is interrupted for any of the following reasons: due to the user's instruction to interrupt the print output, due jamming of recording sheets, due to the opening and closing operation of the door of main image forming apparatus body 30, or due to the completion of outputting operations for the instructed job, general control section 100 determines that the correcting operation is on the way, after which the control flow advances to step S130. If the correcting operation is completed between successive recording sheets P, though the image forming operation has been interrupted, the control flow advances to step S170.

In step S130, general control section 100 determines whether to execute any residual correcting operation (being the recovering operation) during the operation of the present job. If general control section 100 determines that said recovering operation is to be executed during the present job, general control section 100 advances the control flow to step S140, while if general control section 100 determines that said recovering operation is not to be executed during the present job, the control flow advances to step S160.

In step S140, general control section 100 determines whether it is possible to execute the correcting operation before image forming section 40 stops the image formation.

For example, in a case that the correcting operation is stopped, because: due to the user's instruction to interrupt the print output, due to no recording sheet stored in the sheet tray, or due to the completion of outputting operations for the instructed job, image forming section 40 is not necessary to stop the image forming operation, but is possible to execute said operation. In this case, general control section 100 determines that the correcting operation is possible to be executed before image forming section 40 stops the operation, and then the control flow advances to step S150.

On the other hand, in a case that the correcting operation is stopped due to jamming of recording sheets, or due to opening or closing operation of the door of main image forming apparatus body 30, image forming section 40 should be stopped at once, so that general control section 100 determines that any further correcting operation cannot be executed before image forming section 40 is stopped, and then the control flow advances to step S160.

In step S150, general control section 100 executes the first recovery-correcting operation. For example, in FIG. 4, in the toner-density correction, when correction patches 80Y and 80M have been formed as a first step, if the correcting operation is interrupted, residual correction patches 80Y, 80M, 80C, and 80K are formed together.

In step S160, general control section 100 stores information for the correcting operations in memory section 160, wherein said information includes that the second recovery-correcting operation is necessary to be conducted.

In step S170, general control section 100 stops the operation of image forming section 40, so that the present job is completed. Further, when the next job is started, the control flow returns to step S10, in which general control section 100 determines if the second recovery-correcting operation is present or absent.

As detailed above, based on the first recovery-correcting operation shown in the present embodiment, remaining correction patches 80 are formed before image forming section 40 stops, so that correction patches 80 for all colors can be formed under the same environment and same image forming condition. Due to this structure, regardless of the possibility of interruption of the correcting operation, it is possible to calculate the optimal correcting value, and obtain precise outputted images.

Further, in the first recovery-correcting operation, even when the correcting operation has been interrupted, if image forming section 40 is possible to operate, residual correction patches 80 are formed together, whereby the interrupted correcting operation is not necessary to stand by until the next job starts, so that the correcting operation can be more quickly conducted.

Based on the second recovery-correcting operation of the present embodiment, after the present job is stopped, all of correction patches 80 can be formed when the next instructed job starts, so that correction patches 80 for all colors can be formed under the same environment and same image forming conditions. Due to this, regardless of the possibility of interruption of the correcting operations, it is possible to calculate the optimal correcting value, and obtain precise outputted images.

Further, in the second recovery-correcting operation, it is possible to select either the total processing line speed or the processing line speed only for a job to be outputted from now, based on the setting condition. Accordingly, the correction values can be precisely calculated, and can be calculated within a shortened time, which improve how to use for the user.

Still further, in the present embodiment, based on the stopping condition of the correcting operation, since it is possible to select either the first recovery-correcting operation or the second recovery-correcting operation, correction patch 80 can be formed by the optimal correcting operation.

In addition, the technical scope of the present invention is not limited to the above described embodiments, but includes various alternations of the above embodiments, altered within the scope of the purpose of the present invention.

For example, the processing functions of correcting-operation executing section 130 and execution determining section 140 can be structured to be conducted by general control section 100.

Still further, in the explanation of the above described embodiments, the first and second recovery-correcting operations of the present invention are applied to the toner-density correction. However, they can also be applied to the color-registration correction.

Concerning the industrial availableness of the present invention, the present invention can be applied to the correcting operations, such as color-registration correction and toner-density correction, while the image formation is conducted.

Based on the invention described in item 1, before the image forming section is stopped, the residual toner images, to be used for toner-density correction, can be formed, whereby the correcting toner images, to be used for the toner-density correction, can be formed under the same environment and same image forming conditions. Accordingly, regardless of the possibility of interruption of the correcting operation, it is possible to calculate the optimal correcting value, and obtain precise outputted images.

Based on the invention described in item 2, after the present job is stopped, all of the color toner images for correction can be formed when the next job starts, so that said toner image for correction can be formed under the same environment and the same image forming conditions. Accordingly, regardless of the possibility of the interruption of the correcting operation, it is possible to calculate the optimal correcting value, and obtain precise outputted images.

Due to the invention described in item 3, based on the stopping condition of the correcting operation, either the first recovery-correcting operation or the second recovery-correcting operation is selected, accordingly, it is possible to form the toner image for the correction by the optimal correcting operations. Due to this, regardless of the possibility of interruption of the correcting operation, it is possible to calculate the optimal correcting value, and obtain precise outputted images.

What is claimed is:

1. A full-color image forming apparatus for forming a toner image for each color on an image carrier, and for transferring the toner image onto a recording sheet, the apparatus comprising:

an image forming section which conducts a forming operation of a correcting toner image for each color on a portion of the image carrier, wherein the portion corresponds to an interval between successive recording sheets; and a control section which conducts a correcting operation of the toner image for each color, based on the correcting toner image which is formed by the image forming section, wherein, when the image forming section is controlled to interrupt the forming operation of the correcting toner image, if it is possible for the image forming section to conduct the forming operation, the control section controls the image forming section to form a residual correcting toner image, before the control section controls the image forming section to stop the forming operation.

2. The full-color image forming apparatus of claim 1, wherein, if the image forming section is controlled to interrupt the forming operation of the correcting toner image due to a user's instruction, or due to no more sheets stored in a sheet supplying tray, the control section determines that it is possible for the image forming section to conduct the forming operation of the correcting toner image.

3. A full-color image forming apparatus for forming a toner image for each color on an image carrier, and for transferring the toner image onto a recording sheet, the apparatus comprising:

an image forming section which conducts a forming operation of a correcting toner image for each color on a portion of the image carrier, wherein the portion corresponds to an interval between successive recording sheets;

a control section which conducts a correcting operation of the toner image for each color, based on the correcting toner image which is formed by the image forming section; and a memory section which stores information, wherein when the image forming section is controlled to interrupt the forming operation of the correcting toner image during a present image forming job: (i) the control section stores information regarding the forming operation in the memory section based on the interrupt, and (ii) the control section reads out said information for the interrupt, and controls the image forming section to form together, the correcting toner image for each color based on said information read out from the memory section, before the image forming section forms the toner image during a next image forming job.

4. The full-color image forming apparatus of claim 3, wherein, the control section includes a plurality of processing line speeds for switching a speed to form the toner image, and wherein when the control section controls the image forming section to form the correcting toner image, the control section controls the image forming section to one of: (i) form the correcting toner image for each color for all of the plurality of the processing line speeds, and (ii) form the correcting toner image for each color using a processing line speed for the present image forming job, which is set from among the plurality of the processing line speeds.

5. A full-color image forming apparatus for forming a toner image for each color on an image carrier, and for transferring the toner image onto a recording sheet, the apparatus comprising:

an image forming section which conducts a forming operation of a correcting toner image for each color on a portion of the image carrier, wherein the portion corresponds to an interval between successive recording sheets;

a control section which conducts a correcting operation of the toner image for each color, based on the correcting toner image which is formed by the image forming section; and a memory section which stores information, wherein when the image forming section is controlled to interrupt the forming operation of the correcting toner image:

(i) the control section stores information regarding the forming operation of the correcting toner image in the memory section based on the interrupt, (ii) if it is possible for the image forming section to conduct the forming operation, then the control section controls the image forming section to form a residual correcting toner image yet to be formed, under a first recovery-correcting operation, based on the information stored in the memory section, before the control section controls the image forming section to stop the forming operation of the correcting toner image, and if it is not possible for the image forming section to conduct the forming operation, then the control section controls the image forming section to form together, the correcting toner image for each color, under a second recovery-correcting operation, based on the information stored in the memory section, before the image forming section forms the toner image in a next image forming job, and (iii) the control section determines whether to operate the first recovery-correcting operation or the second recovery-correcting operation, based on a stopping condition of the image forming section stored in the memory section.

* * * * *